US006432159B1

(12) United States Patent
Saito et al.

(10) Patent No.: US 6,432,159 B1
(45) Date of Patent: Aug. 13, 2002

(54) MAGNETIC MIXTURE

(75) Inventors: Takanobu Saito, Okazaki; Satoshi Takemoto, Ichinomiya; Toshiaki Yashiro, Kuwana; Haruo Koyama, Tokai; Shinichiro Yahagi, Obu, all of (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 42 days.

(21) Appl. No.: 09/671,692

(22) Filed: Sep. 28, 2000

(30) Foreign Application Priority Data

| | | |
|---|---|---|
| Oct. 4, 1999 | (JP) | 11-283102 |
| Dec. 28, 1999 | (JP) | 11-374450 |
| Jul. 25, 2000 | (JP) | 2000-224239 |

(51) Int. Cl.[7] ..... B22F 1/100
(52) U.S. Cl. ..... 75/255; 75/252
(58) Field of Search ..... 75/255, 252; 148/300, 148/100; 252/62.51 R

(56) References Cited

U.S. PATENT DOCUMENTS

| | | | | | |
|---|---|---|---|---|---|
| 4,585,480 | A | * | 4/1986 | Tengzelius et al. | 75/255 |
| 5,505,760 | A | * | 4/1996 | Jansson | 75/255 |
| 5,647,886 | A | * | 7/1997 | Kitazawa et al. | 75/235 |

* cited by examiner

*Primary Examiner*—Ngoclan Mai
(74) *Attorney, Agent, or Firm*—Frishauf, Holtz, Goodman, Langer & Chick, P.C.

(57) ABSTRACT

A magnetic mixture comprising at least two kinds of powders which are uniformly mixed with each other. Each powder exhibits a significant magnetic property when its constituent elements have a predetermined composition ratio. Magnetic properties of each powder are retained in the magnetic mixture which exhibits, as a whole, a soft magnetic property. The magnetic mixture is useful as a raw material for a powder magnetic core.

16 Claims, No Drawings

MAGNETIC MIXTURE

BACKGROUND OF THE INVENTION

1. Field of the Invention

The present invention relates to a magnetic mixture, and more particularly, to a magnetic mixture of two or more kinds of soft magnetic material powders which are uniformly mixed with each other, which mixture is useful as a raw material for the production of products having the intended magnetic properties.

2. Prior Art

Powder magnetic cores are frequently used in a smoothing choke coil provided on the direct current output side of a switching regulator, a reactor of an active filter provided in an inverter controller, and the like.

The powder magnetic core is generally produced by adding a predetermined amount of an insulating binder such as water glass to a powder of a soft magnetic alloy having predetermined magnetic properties and by subjecting the resultant mixture to press molding.

As a raw material for a powder magnetic core, soft magnetic alloys such as an Fe—Si alloy, an Fe—Si—Al alloy and an Fe—Ni alloy are used. Pure iron, other than an alloy, having high saturation magnetization is also used.

In the preparation of these alloys, the aforementioned constituent elements are added to Fe serving as a base element in such a manner that a predetermined composition ratio is attained.

When the composition ratio of the constituent elements of the alloy varies, magnetic properties of the alloy also vary. At a particular composition ratio, there appears a significant point in magnetic properties of the alloy, i.e., a significant magnetic property, such that the saturation magnetization, permeability, magnetostriction, magnetic anisotropy constant or the like has a local maximum, a local minimum, or a value of substantially zero.

For example, in the case of the Fe—Si—Al alloy, when the composition ratio of Si or Al is varied, the degree to which the significant magnetic properties that manetostriction becomes substantially zero and the permeability has a local maximum are exhibited also vary. At the composition ratio where Si is 9.0 to 10.0% by weight and Al is 5.0 to 6.0% by weight, both the significant magnetic properties appear, and hence an alloy having the magnetostriction of substantially zero and a maximum value of permeability can be obtained. A representative example of such an alloy has the composition of Fe-9.5% Si-5.5%Al, which is a soft magnetic alloy generally called Sendust. By using this alloy, it is possible to produce a magnetic core having a small core loss.

In this manner, a soft magnetic alloy for use as a raw material for a powder magnetic core is prepared: to have a significant point in magnetic property by determining the composition ratio of the constituent elements in accordance with the intended properties of the powder magnetic core.

For example, among the Fe—Si alloys, there can be mentioned an Fe-6.5% Si alloy having the significant property that the magnetostriction is substantially zero. As the Fe—Si—Al alloy, Sendust having the above-mentioned composition can be mentioned. As the Fe—Ni alloy, an Fe-80% Ni-2% Mo alloy generally called PC permalloy can be mentioned, which has both the significant property that the magnetostriction is substantially zero and the significant property that permeability has a local maximum. As the Fe—Co alloy, there can be mentioned an Fe-49% Co-2% V alloy and an Fe-50% Co alloy, which are generally called permendur and exhibit the significant property that the saturation magnetization has a local maximum.

A powder magnetic core produced using a powder of Sendust has a low coercive force, achieving such properties that the core loss is reduced and the permeability is high. However, Sendust has low saturation magnetization, exhibiting low permeability when a large current flows therethrough. In some application fields, the powder magnetic core produced solely from Sendust may have unsatisfactory performance in practical use.

Recently, powder magnetic cores have been sometimes requested to have essential magnetic properties by retaining significant magnetic properties of the raw material, whereas magnetic properties other than essential magnetic properties may be maintained in the cores at individual grade levels. However, by use of the conventional raw material prepared to exhibit one significant property, the resultant powder magnetic core also exhibits one significant property. Thus, the above-mentioned demand cannot be met. For example, such a demand that the powder magnetic core must have a plurality of essential magnetic properties, e.g., core loss and saturation magnetization, or core loss and permeability, cannot be satisfied.

OBJECTS AND SUMMARY OF THE INVENTION

It is an object of the present invention to provide a magnetic mixture in which, among the significant magnetic properties of a raw material (soft magnetic alloy) for a powder magnetic core to be produced, those significant magnetic properties which are required of the powder magnetic core are retained in the magnetic mixture, although unnecessary significant magnetic properties are permitted to be deteriorated.

It is another object of the present invention to provide a magnetic mixture which can be produced simply by uniformly mixing at least two kinds of soft magnetic material powders, at lower costs as compared to the conventional magnetic mixture, and which makes it possible to produce a powder magnetic core at a high degree of freedom of design.

To attain the above objects, the present invention provides a magnetic mixture (hereinafter, referred to as "magnetic mixture 1") comprising at least two kinds of powders which are uniformly mixed with each other, wherein constituent elements of each of the powders have a particular composition ratio to exhibit a significant point in magnetic property. Magnetic properties of each of the powders are retained in the magnetic mixture, and the magnetic mixture exhibits, as a whole, a soft magnetic property.

Further, the present invention provides a magnetic mixture (hereinafter, referred to as "magnetic mixture 2") comprising at least one kind of soft magnetic material powder whose constituent elements having a particular composition ratio to exhibit a significant point:in magnetic property; and at least one different kind of soft magnetic material powder which is uniformly mixed with the at least one kind of soft magnetic material powder, wherein magnetic properties of each of the powders are retained in the magnetic mixture, and the magnetic mixture exhibits, as a whole, a soft magnetic property.

Further, there are provided magnetic mixture 1 and magnetic mixture 2 each further comprising at least one insulating material which is uniformly mixed thereinto.

Furthermore, according to the present invention, a magnetic mixture is provided, which comprises two or three kinds of powders which are uniformly mixed with each other, wherein the powders are selected from the group. consisting of a powder of an Fe-(3.0±0.5)% Si alloy, a powder of an Fe-(6.5±0.5)% Si alloy and a powder of an Fe-(9.5±0.5)% Si-(5.5±0.5)% Al alloy. Further, a magnetic mixture is provided, which comprises the just-mentioned magnetic mixture of 70% by weight or more and a powder of pure iron of 30% by weight or less.

DETAILED DESCRIPTION OF THE INVENTION

First, a magnetic mixture 1 is described.

The magnetic mixture 1 is obtained by uniformly mixing together two or more kinds of soft magnetic material powders.

More specifically, as the soft magnetic material, a soft magnetic alloy is used, which must exhibit not only a soft magnetic property but also a significant point in magnetic property, i.e., a significant magnetic property, when its constituent elements have a particular composition ratio. Examples of such soft magnetic alloys include one that exhibits, when it has a particular composition, a significant property such that the magnetostriction or the magnetic anisotropy constant has a value of substantially zero, or the permeability has a local maximum or the coercive force has a local minimum, or the saturation magnetization has a local maximum.

More strictly, when it is assumed that a magnetic property f of the soft magnetic material is represented by $f(C_1, C_2, \ldots, c_n)$, where $C_1, C_2, \ldots, c_n$ denote the composition ratios of individual constituent elements $a_1, a_2, \ldots,$ and $a_n$ of the soft magnetic material, the soft magnetic material has those composition ratios of constituent elements which satisfy the following equation:

$$f(C_1, C_2, \ldots, c_n)=0,$$

or $$\frac{\partial f}{\partial c_i} = 0$$

wherein i is 1, 2, . . . , n.

It is noted that variations are allowed so long as they fall within the industrially acceptable range.

As the soft magnetic alloys, by way of example, the following can be mentioned.

As the Fe—Si alloy, there can be mentioned an Fe-6.5% Si alloy which exhibits a significant point in magnetic property, i.e., a significant property, such that the magnetostriction has a value of substantially zero.

As the Fe—Si—Al alloy, there can be mentioned an Fe-9.5% Si-5.5% Al (Sendust) which simultaneously exhibits significant magnetic properties such that the magnetostriction and the magnetic anisotropy constant have a value of substantially zero, the permeability has a local maximum, and the coercive force has a local minimum.

As the Fe—Ni alloy, there can be mentioned an Fe-80% Ni-2% Mo (PC permalloy) which simultaneously exhibits significant properties such that the magnetostriction is substantially zero and the permeability has a local maximum, and an Fe-46% Ni which exhibits a local maximum of the permeability.

As the Fe—Co alloy, there can be mentioned permendur (Fe-49% Co-2% V, Fe-50% Co) which exhibits significant properties such that the saturation magnetization has a local maximum larger than that of pure iron and the permeability has a local maximum, and Fe-35% Co which exhibits a maximum value of the saturation magnetization.

Pure iron exhibits a maximum value of the saturation magnetization, and the saturation magnetization of pure iron is lowered when other elements are added thereto.

To be noted, the wording "magnetostriction is substantially zero" used here means that the magnetostriction having an absolute value of zero is optimal, but may vary within the industrially acceptable range.

The magnetic mixture 1 is produced by uniformly mixing together powders of the above-mentioned two or more soft magnetic alloys.

In this case, the alloy powders to be mixed are appropriately selected in accordance with the magnetic properties required of the powder magnetic core to be produced.

For example, when essential magnetic properties required of the powder magnetic core to be produced are such that the magnetostriction is zero and the permeability and the saturation magnetization have appropriate values, powders of two or more kinds of soft magnetic alloys, each exhibiting the significant property such that the magnetostriction is zero, are selected and uniformly mixed with each other.

For example, when a powder of an Fe-6.5% Si alloy and a powder of an Fe-9.5% Si-5.5% Al (Sendust) are uniformly mixed with each other, the powder magnetic core produced using the resultant mixture has the magnetostriction of zero, irrespective of the mixing ratio of the alloys. In this case, the permeability which is another significant property of Sendust powder is lowered by the dilute effect of the presence of the Fe-6.5% Si powder.

The mixture obtained by mixing together the above-mentioned two kinds of powders contains Fe, Si and Al as constituent elements, and the ratio of quantity of these elements varies depending on the mixing ratio of them. On the other hand, even when a powder of an Fe—Si—Al alloy having that composition ratio of the constituent elements which is the same as the ratio of quantity of the just-mentioned mixture is used, the resultant powder magnetic core does not exhibit the significant magnetic property, i.e., the specific point in magnetic properties, such that the magnetostriction is zero.

When a powder of pure iron and a powder of permendur which have a common significant property in respect of the saturation magnetization are mixed with each other, the common significant property is retained in the powder magnetic core produced using the resultant mixture, whereby an inexpensive soft magnetic material exhibiting high saturation magnetization can be provided.

As mentioned above, the magnetic mixture 1 of the present invention is obtained by uniformly mixing together two or more kinds of alloy powders each exhibiting a particular significant property, and is featured in that the magnetic properties of respective alloy powders observed before mixing are retained as they are, and that the mixture exhibits, as a whole, a soft magnetic property.

Therefore, the ratio of the constituent elements of each soft magnetic alloy powder should not be changed by subjecting the magnetic mixture 1 to diffusion sintering at a high temperature, carburizing, decarburization, or the like.

It is preferred that at least one insulating material is uniformly mixed with the magnetic mixture 1, to improve the electric resistivity and suppress the eddy current loss.

As the insulating material, an insulating material having a binding ability is mixed, for example. During the pressing, the powders of the magnetic mixture 1 are bound together to be formed into a desired shape, and insulation between the particles is achieved so that an eddy current is suppressed when the powder magnetic core is in actual use.

As such an insulating material, there can be mentioned water glass; insulating materials of a type having a binding ability, such as phenolic resins, nylon resins, epoxy resins, silicone resins; other insulating materials or oxides such as silica, alumina, zirconia and magnesia; and mixtures thereof.

Next, the aforementioned magnetic mixture 2 of the present invention is described.

The magnetic mixture 2 is obtained by uniformly mixing a powder of at least one, preferably two or more kinds of soft magnetic materials, each exhibiting a significant magnetic property when it has a predetermined composition, with a different kind of soft magnetic material, more specifically, with one or more different kinds of powders of soft magnetic alloys.

The different kind of powder may be a powder exhibiting a significant magnetic property as in the case of magnetic mixture 1 or a powder exhibiting no significant property. That is, the different kind of powder may be any alloy material powder as long as it has a soft magnetic property.

By way of examples, such powders include a powder of an Fe—Si alloy such as an Fe-4% Si alloy; a powder of an Fe—Si—Al alloy such as an Fe-3% Si-2% Al alloy; a powder of an Fe—Ni alloy such as an Fe-65% Ni alloy. Of these, an Fe-4% Si alloy powder is preferred because it is relatively inexpensive.

With respect to the magnetic properties of the magnetic mixture 2 basically comprised of a material powder which exhibits a significant property, this significant property of the material powder is retained in the mixture 2. The mixture 2 further contains a different kind of soft magnetic powder such as an inexpensive soft magnetic powder, so that the mixture 2 is low-priced as a whole.

As for the magnetic mixture 2, it is preferred that an insulating material is uniformly mixed for the same reason as that mentioned on the magnetic mixture 1.

EXAMPLES 1 TO 3 AND COMPARATIVE EXAMPLES 1 TO 3

Powder A of an Fe-9.5% Si-5.5% Al alloy (Sendust) and powder B of an Fe-6.5% Si alloy were prepared. The powder A has significant properties, i.e., significant points in magnetic properties, such that the magnetostriction is substantially zero, the magnetic anisotropy constant is substantially zero, the permeability is maximum, and the coercive force is minimum, whereas the powder B has a significant property such that the magnetostriction is substantially zero.

The powders A and B were produced by a water atomizing method, and each have a particle size or grain size of smaller than 100 mesh (Tyler sieve).

These powders were mixed with each other in the mixing proportions (wt%) shown in Table 1, to obtain mixtures. To each of the obtained mixtures were added 2% by weight water glass and 0.5% by weight zinc stearate (lubricant). The resultant mixture was thoroughly kneaded and the thus kneaded mixture was subjected to press molding at a pressure of 13 tons/cm$^2$, to prepare samples for measurement of magnetic properties.

A sample for measurements of permeability and core loss was formed into a shape having 25 mm outer diameter, 20 mm inner diameter, and 5 mm thickness. A sample for measurements of saturation magnetization and magnetostriction was formed into a shape having 2 mm height, 2 mm width, and 30 mm length.

As for Comparative Example 3 shown in Table 1, an Fe-8.1% Si-2.8% Al alloy was prepared, whose constituent elements have a composition ratio which is the same as the ratio of quantity of the constituent elements of Example 2. The thus prepared alloy was subjected to water atomization to obtain a powder having a particle size of smaller than 100 mesh. Using the powder, samples were prepared in the same manner as in Examples 1–3.

Next, the prepared samples were subjected to heat treatment at a temperature of 700° C. for 1 hour, and then, the above-mentioned magnetic properties were measured.

The saturation magnetization was measured by a VSM method (applied magnetic field: 800 kA/m); the permeability was measured by means of an LCR meter (25 kHz); the magnetostriction was measured by a strain gauge application method; and the core loss was measured under conditions of 25 kHz and 0.1 T.

The results are shown in Table 1.

TABLE 1

| | Magnetic mixture (mixing proportion, wt %) | | Magnetic properties | | | |
|---|---|---|---|---|---|---|
| | Powder A | Powder B | Saturation magnetization (T) | Permeability | Magnetostriction | Core loss ($kW/m^3$) |
| Comparative Example 1 | 100 | — | 0.78 | 120 | $\leqq 1 \times 10^{-6}$ | 80 |
| Example 1 | 70 | 30 | 0.89 | 115 | $\leqq 1 \times 10^{-6}$ | 95 |
| Example 2 | 50 | 50 | 1.10 | 110 | $\leqq 1 \times 10^{-6}$ | 110 |
| Example 3 | 30 | 70 | 1.26 | 99 | $\leqq 1 \times 10^{-6}$ | 130 |
| Comparative Example 2 | — | 100 | 1.43 | 95 | $\leqq 1 \times 10^{-6}$ | 150 |
| Comparative Example 3 | Alloy powder having composition equivalent to that in Example 2 | | 1.09 | 85 | $3 \times 10^{-6}$ | 190 |

From Table 1, the following are clarified.

(1) As is apparent from Examples 1 to 3, when the powder A and powder B, which have a common significant property such that the magnetostriction is substantially zero, are mixed with each other, the resultant mixture exhibits the common significant property.

(2) However, in the case of the alloy powder (Comparative Example 3) having the composition equivalent to that in Example 2, the significant property common to the powder A and powder B disappears, and the magnetostriction is increased. Further, the permeability small and the core loss is large.

(3) Accordingly, when the mixtures 1 in Examples are used, products exhibiting small magnetostriction, large permeability and small core loss can be produced, as compared to those obtained by using alloy powders having the compositions equivalent to those in Examples.

Next, the samples were subjected to practical test.

First, a coil having a diameter of 1 mm was wound in a toroidal form 22 turns around the sample for the measurement of core loss, to thereby obtain a boost choke coil.

Then, the choke coil was incorporated into a DC-DC converter and the power loss was measured. The DC-DC converter was operated under conditions such that the converter output power was 60 W at an input of 14 V and at an output of 60 V and the switching frequency was 25 kHz, and the input power was measured to determine a power loss of the entire circuit from the difference between the measured input power and the output power (60 W). The results are shown in Table 2.

TABLE 2

| Type of magnetic core in choke coil | Power loss (W) |
|---|---|
| Magnetic core using magnetic mixture in Comparative Example 1 | 9.2 |
| Magnetic core using magnetic mixture in Example 1 | 8.5 |
| Magnetic core using magnetic mixture in Example 2 | 8.1 |
| Magnetic core using magnetic mixture in Example 3 | 7.8 |
| Magnetic core using magnetic mixture in Comparative Example 2 | 9.1 |
| Magnetic core using magnetic mixture in Comparative Example 3 | 10.5 |

As is apparent from Tables 1 and 2, the magnetic core obtained using the magnetic mixture in Comparative Example 1 is small in core loss, but has a small saturation magnetization. Thus, the power loss of the magnetic core is large due to saturation and a large current flowing therethrough. As for the magnetic core obtained using the magnetic mixture in Comparative Example 2, the saturation magnetization is large, but the core loss is large, resulting in a large power loss.

By contrast, each of the magnetic cores obtained using the magnetic mixtures in Examples 1 to 3 has a good balance between the saturation magnetization and the core loss, resulting in a small power loss.

EXAMPLES 4 TO 6 AND COMPARATIVE EXAMPLES 4 TO 6

First, powder A of an Fe-46% Ni alloy which exhibits a significant property such that the permeability is maximum was prepared, and powder B of an Fe-80% Ni-2% Mo alloy which exhibits significant properties such that the magnetostriction is substantially zero, the permeability is maximum, and the coercive force is minimum was prepared. Each powder was prepared by means of gas atomization, and has a particle size of smaller than 100 mesh.

These powders were mixed with each other in the mixing proportions (wt%) shown in Table 3, to thereby obtain mixtures, and using the mixtures, samples for the measurement of magnetic properties were prepared in the same manner as in Examples 1 to 3.

In Comparative Example 6 shown in Table 3, a powder of an Fe-64% Ni-1.1% Mo alloy having the composition equivalent to that in Example 5 was used.

With respect to each of the samples obtained using the powders, the magnetic properties were measured in the same manner as in Examples 1 to 3, and the results are shown in Table 3.

TABLE 3

| | Magnetic mixture (mixing proportion, wt %) | | Magnetic properties | | | |
|---|---|---|---|---|---|---|
| | Powder A | Powder B | Saturation magnetization (T) | Permeability | Magnetostriction | Core loss ($kW/m^3$) |
| Comparative Example 4 | 100 | — | 1.31 | 95 | $30 \times 10^{-6}$ | 125 |
| Example 4 | 70 | 30 | 1.13 | 118 | $24 \times 10^{-6}$ | 115 |
| Example 5 | 50 | 50 | 1.00 | 128 | $13 \times 10^{-6}$ | 90 |
| Example 6 | 30 | 70 | 0.86 | 137 | $6 \times 10^{-6}$ | 70 |
| Comparative Example 5 | — | 100 | 0.68 | 150 | $\leqq 1 \times 10^{-6}$ | 65 |
| Comparative Example 6 | Alloy powder having composition equivalent to that in Example 5 | | 0.98 | 101 | $22 \times 10^{-6}$ | 105 |

Although the significant properties of the powder B are diluted, the mixture powders in Examples 4 to 6 exhibit high permeability, as compared to the alloy powder (Comparative Example 6) having the composition equivalent to those of Examples.

Next, the samples were subjected to practical test.

First, a coil having a diameter of 1 mm was wound in a toroidal form 22 turns around the sample for the measurement of core loss, to thereby obtain a boost choke coil.

Then, the choke coil was incorporated into a DC-DC converter and the power loss was measured. The DC-DC converter was operated under conditions such that the converter output power was 60 W at an input of 14 V and at an output of 60 V and the switching frequency was 25 kHz, and the input power was measured to determine the entire circuit from the difference between the measured input power and the output power (60 W). The results are shown in Table 4.

TABLE 4

| Type of magnetic core in choke coil | Power loss (W) |
|---|---|
| Magnetic core using magnetic mixture in Comparative Example 4 | 5.2 |
| Magnetic core using magnetic mixture in Example 4 | 4.1 |
| Magnetic core using magnetic mixture in Example 5 | 3.8 |
| Magnetic core using magnetic mixture in Example 6 | 4.3 |
| Magnetic core using magnetic mixture in Comparative Example 5 | 5.3 |
| Magnetic core using magnetic mixture in Comparative Example 6 | 6.3 |

As is apparent from Tables 3 and 4, the magnetic core obtained using the magnetic mixture in Comparative Example 4 is small in core loss, but has a small saturation magnetization, so that the power loss of the magnetic core is large due to the saturation and a large current flowing therethrough. As for the magnetic core obtained using the magnetic mixture in Comparative Example 6, the saturation magnetization is large, but the core loss is large, resulting in a large power loss.

By contrast, each of the magnetic cores obtained using the magnetic mixtures in Examples 4 to 6 achieves a good balance between the saturation magnetization and the core loss, resulting in a small power loss.

EXAMPLES 7 TO 9 AND COMPARATIVE EXAMPLES 7 TO 9

Powder A of an Fe-46% Ni alloy produced by means of water atomization and having a particle size of smaller than 145 mesh, and powder B of an Fe-9.5% Si-5.5% Al alloy produced by an atomizing method using water and gas and having a particle size of smaller than 200 mesh were prepared.

These powders were mixed with each other in the mixing proportions (wt%) shown in Table 5, to thereby obtain mixtures, and using the obtained mixtures, samples for the measurement of magnetic properties were prepared in the same manner as in Examples 1 to 3.

In Comparative Example 9 shown in Table 5, a powder (smaller than 145 mesh) of an Fe-22% Ni-4.7% Si-2.6% Al alloy having the composition equivalent to the quantity ratio of constituent elements in Example 8 was used.

With respect to each of the samples obtained using the above-mentioned powders, the magnetic properties were measured in the same manner as in Examples 1 to 3. The results are shown in Table 5.

TABLE 5

| | Magnetic mixture (mixing proportion, wt %) | | Magnetic properties | | | |
|---|---|---|---|---|---|---|
| | Powder A | Powder B | Saturation magnetization (T) | Permeability | Magnetostriction | Core loss ($kW/m^3$) |
| Comparative Example 7 | 100 | — | 1.38 | 95 | $30 \times 10^{-6}$ | 120 |
| Example 7 | 70 | 30 | 1.17 | 91 | $22 \times 10^{-6}$ | 110 |
| Example 8 | 50 | 50 | 1.03 | 110 | $15 \times 10^{-6}$ | 95 |
| Example 9 | 30 | 70 | 0.91 | 116 | $5 \times 10^{-6}$ | 85 |
| Comparative Example 8 | — | 100 | 0.78 | 120 | $\leqq 1 \times 10^{-6}$ | 75 |
| Comparative Example 9 | Alloy powder having composition equivalent to that in Example 8 | | 1.03 | 45 | $29 \times 10^{-6}$ | 290 |

In the above cases, although the two significant properties of the powder B are diluted, the mixture powders in Examples 7 to 9 exhibit small magnetostriction and high permeability, as compared to the alloy powder (Comparative Example 9) having the equivalent composition.

EXAMPLES 10 TO 12 AND COMPARATIVE EXAMPLES 10 TO 12

Powder A of pure iron having a particle size of smaller than 200 mesh was produced by means of water atomization, and powder B of an Fe-80% Ni-2% Mo alloy having a particle size of smaller than 100 mesh was produced by gas atomization.

These powders were mixed with each other in the mixing proportions (wt%) shown in Table 6, to obtain mixtures, and using the mixtures, samples for the measurement of magnetic properties were prepared in the same manner as in Examples 1 to 3.

In Comparative Example 12 shown in Table 6, a powder (smaller than 200 mesh) of an Fe-40% Ni-1% Mo alloy having the composition equivalent to that in Example 11 was used.

With respect to each of the samples obtained using the above powders, the magnetic properties were measured in the same manner as in Examples 1 to 3, and the results are shown in Table 6.

In the above cases, although the two significant properties of the powder B are diluted, the mixture powders in Examples 10 to 12 exhibit small magnetostriction and high permeability, as compared to the alloy powder (Comparative Example 12) having the equivalent composition. Further, the powders in these Examples realized a reduction of cost by using inexpensive pure iron.

EXAMPLES 13 TO 15 AND COMPARATIVE EXAMPLES 13 TO 15

Powder A of an Fe-4% Si alloy having a particle size of smaller than 145 mesh was produced by atomization using water and gas, and powder B of an Fe-49% Co-2% V alloy having a particle size of smaller than 145 mesh was produced by water atomization.

These powders were mixed with each other in the mixing proportions (wt%) shown in Table 7, to thereby obtain mixtures, and using the mixtures, samples for the measurement of magnetic properties were prepared in the same manner as in Examples 1 to 3.

In Comparative Example 15 shown in Table 7, a powder (smaller than 145 mesh) of an Fe-25% Co-1.1% V-2.0% Si alloy having the composition equivalent to that in Example 14 was used.

With respect to each of the samples obtained using the above powders, the magnetic properties were measured in

TABLE 6

| | Magnetic mixture (mixing proportion, wt %) | | Magnetic properties | | | |
|---|---|---|---|---|---|---|
| | Powder A | Powder B | Saturation magnetization (T) | Permeability | Magnetostriction | Core loss ($kW/m^3$) |
| Comparative Example 10 | 100 | — | 1.97 | 105 | $10 \times 10^{-6}$ | 250 |
| Example 10 | 70 | 30 | 1.58 | 108 | $8 \times 10^{-6}$ | 200 |
| Example 11 | 50 | 50 | 1.31 | 121 | $6 \times 10^{-6}$ | 150 |
| Example 12 | 30 | 70 | 0.99 | 130 | $3 \times 10^{-6}$ | 90 |
| Comparative Example 11 | — | 100 | 0.68 | 150 | $\leqq 1 \times 10^{-6}$ | 60 |
| Comparative Example 12 | Alloy powder having composition equivalent to that in Example 11 | | 1.32 | 67 | $29 \times 10^{-6}$ | 350 |

the same manner as in Examples 1 to 3. In the measurement of core loss, two-type conditions for measurement, i.e., conditions of 25 kHz and 0.1 T and conditions of: kHz and 1 T were employed.

The results are shown in Table 7.

TABLE 7

| | Magnetic mixture (mixing proportion, wt %) | | Magnetic properties | | | | |
|---|---|---|---|---|---|---|---|
| | | | Saturation magnetization | | | Core loss (kW/m$^3$) | |
| | Powder A | Powder B | (T) | Permeability | Magnetostriction | Under conditions of 25 kHz and 0.1 T | Under conditions of 1 kHz and 1 T |
| Comparative Example 13 | 100 | — | 1.61 | 105 | $70 \times 10^{-6}$ | 190 | 1250 |
| Example 13 | 70 | 30 | 1.58 | 102 | $62 \times 10^{-6}$ | 175 | 1460 |
| Example 14 | 50 | 50 | 1.83 | 84 | $40 \times 10^{-6}$ | 265 | 1920 |
| Example 15 | 30 | 70 | 1.95 | 71 | $7 \times 10^{-6}$ | 340 | 2250 |
| Comparative Example 14 | — | 100 | 2.04 | 65 | $5 \times 10^{-6}$ | 350 | 2500 |
| Comparative Example | Alloy powder having composition equivalent to that in Example 14 | | 1.81 | 45 | $37 \times 10^{-6}$ | 305 | 2340 |

In the above cases, although the two significant properties of the powder B are diluted, the mixture powders in Examples 13 to 15 can exhibit small magnetostiction and high permeability, as compared to the alloy powder (Comparative Example 15) having the equivalent composition. Further, the powders in these Examples realized a reduction of cost by using the powder of an inexpensive Fe-4% Si alloy.

Next, each of the above magnetic core samples was incorporated into a stator in a direct current brushless motor, and the torque generated when the motor rotated at a rotational speed of 15000 rpm.

The conditions of the direct current brushless motor are as follows.

Stator: outermost diameter: 30 mm, thickness: 5 mm, 9 slots

Rotor: Nd—Fe—B bonded magnet, 8-pole magnet

The results are shown in Table 8 by use of relative values, with the torque for the magnetic core, obtained using the magnetic mixture in Comparative Example 13, being taken as a relative value of 1.0.

TABLE 8

| Type of magnetic core sample | Generated torque (Relative value) |
|---|---|
| Magnetic core using magnetic mixture in Comparative Example 13 | 1.0 |
| Magnetic core using magnetic mixture in Example 13 | 1.3 |
| Magnetic core using magnetic mixture in Example 14 | 1.6 |
| Magnetic core using magnetic mixture in Example 15 | 1.4 |
| Magnetic core using magnetic mixture in Comparative Example 14 | 1.2 |
| Magnetic core using magnetic mixture in Comparative Example 15 | 1.2 |

As is apparent from Tables 7 and 8, the magnetic core obtained using the magnetic mixture in Comparative Example 13 is small in core loss, but the saturation magnetization is also small, and thus, the generated torque of this magnetic core is small due to saturation. In addition, the magnetic core obtained using the magnetic mixture in Comparative Example 14 is large in saturation magnetization, but the core loss is large, resulting in a large power loss and a small generated torque.

By contrast, each of the magnetic cores obtained using the magnetic mixtures in Examples 13 to 15 achieves a good balance between the saturation magnetization and the core loss, resulting in a small power loss, so that the generated torque is large.

EXAMPLES 16 TO 18 AND COMPARATIVE EXAMPLES 16 TO 18

Powder A which of an Fe-6.5% Si alloy having a particle size of smaller than 145 mesh was produced by an atomizing method using water and gas, and powder B of an Fe-80% Ni-2% Mo alloy having a particle size of smaller than 145 mesh was produced by a water atomizing method.

These powders were mixed with each other in the mixing proportions (wt%) shown in Table 9, to thereby obtain mixtures, and using the obtained mixtures, samples for the measurement of magnetic properties were prepared in the same manner as in Examples 1 to 3.

For Comparative Example 18 shown in Table 9, a powder (smaller than 145 mesh) of an Fe-40% Ni-l% Mo-3.3% Si alloy having the composition equivalent to that in Example 17 was used.

With respect to each of the samples obtained using the above powders, the magnetic properties were measured in the same manner as in Examples 1 to 3, and the results are shown in Table 9.

TABLE 9

| | Magnetic mixture (mixing proportion, wt %) | | Magnetic properties | | | |
|---|---|---|---|---|---|---|
| | Powder A | Powder B | Saturation magnetization (T) | Permeability | Magnetostriction | Core loss ($kW/m^3$) |
| Comparative Example 16 | 100 | — | 1.42 | 75 | $\leqq 1 \times 10^{-6}$ | 170 |
| Example 16 | 70 | 30 | 1.23 | 98 | $\leqq 1 \times 10^{-6}$ | 155 |
| Example 17 | 50 | 50 | 1.06 | 128 | $\leqq 1 \times 10^{-6}$ | 120 |
| Example 18 | 30 | 70 | 0.84 | 150 | $\leqq 1 \times 10^{-6}$ | 105 |
| Comparative Example 17 | — | 100 | 0.66 | 185 | $\leqq 1 \times 10^{-6}$ | 80 |
| Comparative Example 18 | Alloy powder having composition equivalent to that in Example 17 | | 0.99 | 73 | $32 \times 10^{-6}$ | 205 |

In the above cases, it is clear that, when the powder A and the powder B having a common significant property such that the magnetostriction is substantially zero are mixed with each other, this significant property is ensured in the resultant powder mixture. Further, the powder mixture exhibits a small magnetostriction, as compared to the alloy powder (Comparative Example 18) having the equivalent composition. Since powder A is inexpensive, the powders in these Examples realize a reduction of cost.

EXAMPLES 19 TO 22 AND COMPARATIVE EXAMPLES 19 TO 22

Powder A of an Fe-6.5% Si alloy, powder B of an Fe-9.5% Si-5.5% Al alloy, and powder C of an Fe-80% Ni-2% Mo alloy, each having a particle size of smaller than 145 mesh were produced by atomization using water and gas.

These powders were mixed with one another in the mixing proportions (wt%) shown in Table 10, to thereby obtain mixtures, and using the obtained mixtures, samples for the measurement of magnetic properties were prepared in the same manner as in Examples 1 to 3.

For Comparative Example 22 shown in Table 10, a powder (having a particle size of smaller than 145 mesh produced by an atomizing method using water and gas) of an Fe-24% Ni-0.6% Mo-5.8% Si-2.2% Al alloy having the composition equivalent to that in Example 21 was used.

With respect to each of the samples obtained using the above powders, the magnetic properties were measured in the same manner as in Examples 1 to 3, and the results are shown in Table 10.

TABLE 10

| | Magnetic mixture (mixing proportion, wt %) | | | Magnetic properties | | | |
|---|---|---|---|---|---|---|---|
| | Powder A | Powder B | Powder C | Saturation magnetization (T) | Permeability | Magnetostriction | Core loss ($kW/m^3$) |
| Comperative Example 19 | 100 | — | — | 1.41 | 92 | $\leqq 1 \times 10^{-6}$ | 140 |
| Example 19 | 70 | 10 | 20 | 1.23 | 105 | $\leqq 1 \times 10^{-6}$ | 120 |
| Example 20 | 50 | 30 | 20 | 1.08 | 112 | $\leqq 1 \times 10^{-6}$ | 90 |
| Example 21 | 40 | 30 | 30 | 0.85 | 128 | $\leqq 1 \times 10^{-6}$ | 80 |
| Example 22 | 20 | 20 | 60 | 0.81 | 131 | $\leqq 1 \times 10^{-6}$ | 80 |
| Comparative Example 20 | — | 100 | — | 0.77 | 125 | $\leqq 1 \times 10^{-6}$ | 70 |
| Comparative Example 21 | — | — | 100 | 0.65 | 140 | $\leqq 1 \times 10^{-6}$ | 60 |
| Comparative Example 22 | Alloy powder having composition equivalent to that in Example 21 | | | 0.82 | 45 | $29 \times 10^{-6}$ | 350 |

In the above cases, the powder A, powder B and powder C have a common significant property such that the magnetostriction is substantially zero. The powder B and powder C have common significant properties such that the permeability has a maximum value and the coercive force has a minimum value. It is clear that, when these three powders are mixed with one another, the resultant powder mixture ensures the significant property common to the three powders and the significant properties common to the two powders although the degree to which these properties are exhibited is diluted to some extent. Further, the powder mixture exhibits small magnetostriction and high permeability, as compared to the alloy powder (Comparative Example 22) having the equivalent composition.

EXAMPLES 23 TO 26 AND COMPARATIVE EXAMPLES 23 TO 26

Powder A of an Fe-46% Ni alloy having a particle size of smaller than 100 mesh was produced by means of water atomization, powder B of an Fe-80% Ni-2% Mo alloy having a particle size of smaller than 145 mesh was produced by water atomization, and powder C of an Fe-9.5% Si-5.5% Al alloy having a particle size of smaller than 200 mesh was produced by gas atomization.

These powders were mixed with one another in the mixing proportions (wt%) shown in Table 11, to thereby obtain mixtures, and using the obtained mixtures, samples for the measurement of magnetic properties were prepared in the same manner as in Examples 1 to 3.

In Comparative Example 26 shown in Table 11, a powder (having a particle size of smaller than 100 mesh produced by water atomization) of an Fe-42% Ni-0.6% Mo-2.9% Si-1.6% Al alloy having the composition equivalent to that in Example 25 was used.

With respect to each of the samples obtained using the above powders, the magnetic properties were measured in the same manner as in Examples 1 to 3, and the results are shown in Table 11.

TABLE 11

| | Magnetic mixture (mixing proportion, wt %) | | | Magnetic properties | | | |
|---|---|---|---|---|---|---|---|
| | Powder A | Powder B | Powder C | Saturation magnetization (T) | Permeability | Magnetostriction | Core loss (kW/m$^3$) |
| Comparative Example 23 | 100 | — | — | 1.32 | 98 | $31 \times 10^{-6}$ | 130 |
| Example 23 | 70 | 10 | 20 | 1.25 | 105 | $22 \times 10^{-6}$ | 100 |
| Example 24 | 50 | 30 | 20 | 1.11 | 110 | $15 \times 10^{-6}$ | 90 |
| Example 25 | 40 | 30 | 30 | 0.93 | 116 | $10 \times 10^{-6}$ | 75 |
| Example 26 | 20 | 20 | 60 | 0.77 | 127 | $3 \times 10^{-6}$ | 70 |
| Comparative Example 24 | — | 100 | — | 0.65 | 135 | $\leqq 1 \times 10^{-6}$ | 60 |
| Comparative Example 25 | — | — | 100 | 0.75 | 117 | $\leqq 1 \times 10^{-6}$ | 75 |
| Comparative Example 26 | Alloy powder having composition equivalent to that in Example 25 | | | 0.91 | 55 | $29 \times 10^{-6}$ | 190 |

In the above cases, the powder A, powder B and powder C have a common significant property such that the permeability is a maximum value, and the powder B and powder C have a common significant property such that the magnetostriction is substantially zero. It is clear that, when these three powders are mixed with one another, the resultant powder mixture has the significant property common to the three powders (high permeability), and also has the significant property common to the two powders although they are diluted to some extent. Further, the powder mixture exhibits small magnetostriction and high permeability, as compared to the alloy powder (Comparative Example 26) having the equivalent composition.

EXAMPLES 27 TO 42 AND COMPARATIVE EXAMPLES 27 TO 29

Powder A of an Fe-3.12% Si alloy having a particle size of smaller than 100 mesh was produced by atomization using water and gas, powder B of an Fe-6.61% Si alloy having a particle size of smaller than 100 mesh was produced by atomization using water and gas. Further, powder C of an Fe-9.48% Si-5.65% Al alloy having a particle size of smaller than 100 mesh was produced by atomization using water and gas, and powder D of pure iron having a particle size of smaller than 100 mesh was prepared.

These powders were mixed with one another in the mixing proportions (wt%) shown in Table 12, to thereby obtain mixtures. To 100 parts by weight of each of the obtained mixtures were added 2 parts by weight of water glass and 0.5 part by weight of zinc stearate, and the resultant mixture was thoroughly kneaded. The kneaded mixture was subjected to press molding at a pressure of 13 tons/cm$^2$ at room temperature, to thereby prepare a powder magnetic core in a toroidal form having a size such that the outer diameter was 25 mm, the inner diameter was 15 mm and the height was 5 mm. Then, the powder magnetic core was subjected to heat treatment in vacuum at a temperature of 700° C. for 1 hour. With respect to each of the obtained magnetic cores, the magnetic properties were measured.

Permeability: Measured using an LCR meter at a frequency of 25 kHz.

Direct current bias properties: The permeability was measured by an LCR meter while flowing a direct bias current therethrough, and the value of the magnetic field, observed when the measured permeability became the half of the initial permeability value, was determined.

Core loss: The power loss was measured at a frequency of 25 kHz at a magnetic flux density of 0.1 T.

The results are shown in Table 12.

With respect to each of the magnetic cores in Examples 27, 28, 34 and 39 and Comparative Examples 27, 28 and 29, a coil having a diameter of 1 mm was wound 23 turns around the magnetic core, to thereby obtain a boost choke coil. The choke coil was incorporated into a DC-DC converter with an input of 14 V and an output of 60 V, and a temperature rise in the magnetic core was measured at a switching frequency of 25 kHz at an output current of 0.9 A. The results are also shown in Table 12.

TABLE 12

| | Magnetic mixture (mixing proportion, wt %) | | | | Magnetic properties | | | |
|---|---|---|---|---|---|---|---|---|
| | Powder A | Powder B | Powder C | Powder D | Permeability | Magnetic field at half permeability (A/m) | Core loss (kW/m$^3$) | Temperature rise in magnetic core (° C.) |
| Example 27 | 50 | 50 | — | — | 64 | 16400 | 40 | 41 |
| Example 28 | 80 | — | 50 | — | 71 | 11760 | 300 | 35 |
| Example 29 | 50 | — | 20 | — | 84 | 9680 | 250 | Not measured |
| Example 30 | 20 | — | 80 | — | 90 | 7280 | 120 | Not measured |
| Example 31 | 72 | — | 18 | 10 | 78 | 11520 | 340 | Not measured |
| Example 32 | 56 | — | 14 | 30 | 85 | 11200 | 480 | Not measured |
| Comparative Example 27 | 40 | — | 10 | 50 | 114 | 11360 | 830 | 64 |
| Example 33 | — | 70 | 30 | — | 65 | 9680 | 250 | Not measured |
| Example 34 | — | 50 | 50 | — | 70 | 7040 | 200 | 40 |
| Example 35 | — | 10 | 90 | — | 100 | 4960 | 70 | Not measured |
| Example 36 | — | 45 | 45 | 10 | 80 | 6800 | 230 | Not measured |
| Example 37 | — | 35 | 35 | 30 | 88 | 6560 | 300 | Not measured |
| Comparative Example 28 | — | 25 | 25 | 50 | 100 | 6560 | 700 | 58 |
| Example 38 | 30 | 50 | 20 | — | 68 | 10560 | 270 | Not measured |
| Example 39 | 30 | 20 | 50 | — | 71 | 8160 | 230 | 35 |
| Example 40 | 10 | 10 | 80 | — | 84 | 6640 | 110 | Not measured |
| Example 41 | 27 | 18 | 45 | 10 | 77 | 8000 | 280 | Not measured |
| Example 42 | 21 | 14 | 35 | 30 | 88 | 8800 | 350 | Not measured |
| Comparative Example 29 | 15 | 10 | 25 | 50 | 107 | 8640 | 490 | 66 |

As is apparent from the foregoing description, the magnetic mixture of the present invention is obtainable simply by uniformly mixing together soft magnetic material powders at least one of which exhibits a significant point in magnetic properties, i.e., a significant magnetic property, when its constituent elements have a predetermined composition ratio. In the magnetic mixture, such a significant property is retained without disappearance. In addition, the magnetic mixture has its magnetic properties superior to those of the alloy powder having the equivalent composition corresponding to the quantity ratio of constituent elements of the magnetic mixture.

Accordingly, the magnetic mixture of the present invention for use as a raw material for a powder magnetic core can be obtained by simply mixing together a plurality of powders having the magnetic properties required of the powder magnetic core to be produced.

What is claimed is:

1. A magnetic mixture comprising:

at least two kinds of powders which are uniformly mixed with each other, constituent elements of each of said powders having a particular composition ratio to exhibit a significant point in magnetic property, magnetic properties of each of said powders being retained in said magnetic mixture, and said magnetic mixture exhibiting, as a whole, a soft magnetic property.

2. A magnetic mixture comprising:

at least one kind of soft magnetic material powder whose constituent elements having a particular composition ratio to exhibit a significant point in magnetic property; and at least one different kind of soft magnetic material powder which is uniformly mixed with said at least one kind of soft magnetic material powder, wherein magnetic properties of each of said powders are retained in said magnetic mixture, and said magnetic mixture exhibits, as a whole, a soft magnetic property.

3. The magnetic mixture according to claim 1, further comprising:

at least one kind of insulating material which is uniformly mixed thereinto.

4. The magnetic mixture according to claim 1, wherein said significant point is a point at which magnetostriction is substantially zero or a magnetic anisotropy constant is substantially zero.

5. The magnetic mixture according to claim 1, wherein said significant point is a point at which permeability has a local maximum, a coercive force has a local minimum, or saturation magnetization has a local maximum.

6. A magnetic mixture comprising:

two or three kinds of powders which are uniformly mixed with each other, said powders being selected from the group consisting of a powder of an Fe-(3.0±0.5)% Si alloy, a powder of an Fe-(6.5±0.5)% Si alloy, and a powder of an Fe-(9.5±0.5)% Si-(5.5±0.5)% Al alloy.

7. A magnetic mixture comprising:

the magnetic mixture as set forth in claim 6 of 70% or more by weight; and a powder of pure iron of 30% or less by weight.

8. The magnetic mixture according to claim 2, further comprising:

at least one kind of insulating material which is uniformly mixed thereinto.

9. The magnetic mixture according to claim 2, wherein said significant point is a point at which magnetostriction is substantially zero or a magnetic anisotropy constant is substantially zero.

10. The magnetic mixture according to claim 3, wherein said significant point is a point at which magnetostriction is substantially zero or a magnetic anisotropy constant is substantially zero.

11. The magnetic mixture according to claim 2, wherein said significant point is a point at which permeability has a local maximum, a coercive force has a local minimum, or saturation magnetization has a local maximum.

12. The magnetic mixture according to claim 3, wherein said significant point is a point at which permeability has a local maximum, a coercive force has a local minimum, or saturation magnetization has a local maximum.

13. The magnetic mixture according to claim 4, wherein said significant point is a point at which permeability has a local maximum, a coercive force has a local minimum, or saturation magnetization has a local maximum.

14. The magnetic mixture according to claim 8, wherein said significant point is a point at which permeability has a local maximum, a coercive force has a local minimum, or saturation magnetization has a local maximum.

15. The magnetic mixture according to claim 9, wherein said significant point is a point at which permeability has a local maximum, a coercive force has a local minimum, or saturation magnetization has a local maximum.

16. The magnetic mixture according to claim 10, wherein said significant point is a point at which permeability has a local maximum, a coercive force has a local minimum, or saturation magnetization has a local maximum.

* * * * *